US005799382A

United States Patent [19]

Brameyer

[11] Patent Number: 5,799,382

[45] Date of Patent: Sep. 1, 1998

[54] MINIATURE LAMP HOLDER EXTRACTION DEVICE

[76] Inventor: Richard K. Brameyer, 2531 W. Tennessee Ave., Tampa, Fla. 33629

[21] Appl. No.: 622,823

[22] Filed: Mar. 27, 1996

[51] Int. Cl.[6] ..... B25B 9/00; H01K 3/32

[52] U.S. Cl. ..... 29/268; 81/302; 445/60

[58] Field of Search ..... 29/268; 81/302; 445/60

[56] References Cited

U.S. PATENT DOCUMENTS

| | | | |
|---|---|---|---|
| D. 318,996 | 8/1991 | Isrgelson | D8/14 |
| D. 355,573 | 2/1995 | Ortiz | D8/14 |
| 3,357,085 | 12/1967 | Martin | 29/268 |
| 4,018,110 | 4/1977 | Spiggs | 29/268 X |
| 4,571,808 | 2/1986 | King | 29/268 |
| 4,852,925 | 8/1989 | Lodin | 294/2 |
| 5,316,512 | 5/1994 | Ell | 445/61 |
| 5,369,363 | 11/1994 | Hey | 324/414 |
| 5,434,510 | 7/1995 | Halstead | 324/555 |

*Primary Examiner*—Kenneth J. Ramsey
*Attorney, Agent, or Firm*—Stephan A. Pendorf, P.A.

[57] ABSTRACT

A device for separating and removing lamp holders from their sockets, and more particularly, a compact device for removing small lamp holders such as those found in miniature light sets from their sockets. The device provides jaws which penetrate into the cleft between the lamp holder and the socket and which can be actuated to apply prying separating forces in this cleft in order to optimally oppose the frictional forces retaining the lamp holder in its socket. The ease of operation and the limited range of movement of the jaws results in a large degree of control in the removal of the lamp holder.

2 Claims, 3 Drawing Sheets

MINIATURE LAMP HOLDER EXTRACTION DEVICE

BACKGROUND OF THE INVENTION

1. Field of the Invention

This invention relates to a device for separating and removing friction lamp holders from their sockets, and more particularly to a compact device for removing small lamp holders such as those found in miniature light sets from their sockets.

2. Discussion of the Related Art

Traditionally, miniature light sets have been used for a number of years for indoor and outdoor lighting for Christmas trees and for other decorations.

The typical miniature light set uses low heat generating miniature lamps (light bulbs) that are contained in individual lamp holders. The lamp holders are designed to physically and electrically engage with sockets which extend from the electrical cord. The lamp has wire leads that extend through the holder and are bent back along the holder so as to make contact with the appropriate electrical connections in the socket. Typically, the socket and holder are molded of materials which allow a certain degree of flexibility and compressibility and are molded in cooperating tapered shapes sufficient to ensure that the lamp holder is securely retained within the socket and that the necessary electrical connections are maintained. Owing to a tapered fit, the frictional forces after insertion are significantly greater that the forces required to do the insertion.

Since miniature lamps have a limited life, they often fail and require replacement. Most modern miniature light sets allow the other lamps to remain on even when one fails. Older, or series wired, sets require each bulb to be tested individually in turn. The actual testing of a lamp can be accomplished quickly with any simple battery device.

The principle inconvenience in the repair operation is in the difficulty in removing the failed lamp-holder assembly from the socket so it can be tested and/or replaced. Because of their small size and the very tight fit between the holder and the socket, the lamp holders are difficult to remove by hand. Besides being inconvenient, there is a risk of injury to the finger or fingernail when attempting to extract a lamp holder from a socket by hand. It is also easy to either break the bulb of the lamp or to pull the lamp completely out of its holder, leaving the holder in the socket. The empty holder still has to be removed, and the lamp, if not damaged, must then be reinserted into the holder and the wires returned to the correct positions. It is also difficult to retain the lamp and/or holder in one's grasp after it is removed.

This difficulty is especially true for those lacking the proper finger motion or lacking sufficient strength, by reason of age, disability or when wearing gloves. The inconvenience is quite often compounded by the location of the lamp to be replaced, as in the case of a completely decorated Christmas tree or the eve of a house. Removing a failed lamp without disturbing its surroundings is sometimes very difficult and has heretofore caused considerable aggravation and discomfort in dealing with replacement.

Various methods have been proposed for avoiding the above disadvantages but none of the methods have been simple and completely successful. There are considerable manufacturing variations in the dimensions of sockets and holders found in miniature light sets, and existing devices are limited in scope to a particular set size.

Typically, lamps had been removed by relying upon a single means to create sufficient force to overcome the friction retaining the lamp assembly within its socket.

For example, U.S. Pat. No. 4,852,925 (Lodin) teaches a lamp replacement device for removing and inserting lamps in a lamp housing which forms part of a flush mounted push button switch as used in aircraft cockpit control panels or computer panels. These lamps are usually located in small recesses and are not accessible by fingers. The slender device is designed to reach into such recesses, and relies totally on a forced frontal wedge and on leverage to dislodge the seated bulb.

U.S. Pat. No. 5,434,510 (Halstead) teaches a tool for testing defective bulbs in miniature Christmas light sets. The tool comprises a nonconductive rod having a double pronged conductive component at one end and a conductive paw component at the other end. The device is designed for testing light sets which do not light up when a single bulb is defective. Rather than removing each bulb and replacing it with a replacement bulb, the device makes it possible to short-circuit lamp lead wires, thereby closing the electrical circuit and bypassing the light bulb. If the light set lights up, the defective mini-lamp is replaced. The device may include a metal fork component to remove the bulb base from the socket. However, the manner in which force is applied against the lamp holder through the elongated tool results in the lamp holder, when suddenly released from the socket, being catapulted across the room. Further, the bulb extractor component can not remove a bulb base which is seated flush against the socket. The bulb removal component is also slender and is thus easily bent. The device is very limited in the range of light bulbs which can be removed. Further, modern light sets do not require a testing function. Thus, there is a need for a more convenient, compact, and effective lamp holder extraction device.

U.S. Pat. No. 5,316,512 (Ell) teaches a bulky pliers-like tool for extracting light bulbs. Each jaw is provided with a wedge. The device operates by placing one wedge on either side of the socket and lamp holder and squeezing the jaws together to force the lamp holder out of the socket. The device must be used with care so as not to damage the delicate plastic lamp holder and socket. The device is limited to only those holders which will fit within the diameter of the jaws and the travel of the holder is limited to the thickness of the wedge which can be formed in the half diameter distance traveled. The device is large and bulky, which makes it difficult to use in tight spaces. The device is also rather elaborate and expensive.

U.S. Pat. No. 5,369,363 ((Hey) teaches an implement for removing, installing and testing Christmas light bulbs. Bulbs are removed by placing the socket/holder assembly in a tapered cavity of the tool, grasping the socket with one hand and the tool with the other hand, and pulling the socket and tool in opposite directions to separate the lamp holder from the socket.

Therefore there is a need for a simple, quick, efficient and effective implement for removing miniature lamp holders from their sockets, which implement will securely hold the lamp holder after removal, and which will extract lamp holders from sockets for the wide range of the miniature light sets currently available.

With the forgoing in mind, it is a principle object of the present invention to provide a device which can remove a wide variety of lamp holders from their sockets.

Another objective of the present invention is to provide a device which will releasably retain the lamp holder once it has been removed from its socket.

Still another objective of the present invention is to provide a device with which it will be possible to remove a lamp holder from a socket, even if the lamp holder is seated flush against a socket. It is another objective to provide a device with which risk of damage to the lamp holder or socket during the extraction process is greatly reduced.

Yet another objective is to provide a device which applies forces at precisely the optimal vantage point for dislodging the lamp holder from the socket.

Yet a further objective of the present invention is to provide an extraction device with which the lamp assembly may be inspected during removal from its socket.

SUMMARY OF THE INVENTION

The present inventor has conducted extensive investigation into the problems associated with conventional devices and has experimented with a number of devices of his own design, and as a result has developed a lamp holder extraction device which extracts lamps of varying sizes from their socket and allows the lamps to be retained in the device.

More particularly, the device according to the present invention provides jaws which penetrate into the cleft between the lamp holder and the socket and which can be actuated to apply prying separating forces in this cleft in order to optimally oppose the frictional forces retaining the lamp holder in its socket. The ease of operation and the limited range of movement of the jaws results in a large degree of control in the removal of the lamp holder.

In one embodiment, the device consists of upper and lower elongate members, each elongate member having a proximal end for grasping by the hand and a distal end for engaging the lamp assembly. At least one of the upper or lower elongate members is bent, preferably at an acute angle, such that when in the rest position the distal ends of the elongate members contact flush against each other, and the proximal ends are spaced apart from each other. Each elongate member can thus be thought of as acting as a rocker arm with respect to the other. The elongate members are capable of pivoting relative to each other with the bend defining the pivot point. The bend serves as a fulcrum point allowing the distal ends of the device to separate as the proximal ends of the device are urged against each other. The device further preferably includes resilient means for biasing the device to the closed or rest position.

Either or both elongate members may have longitudinally extending sides, flanges or ribs along some portion of the length to provide strength and resistance to bending.

The distal ends are preferably tapered towards the region of initial contact with the lamp assembly, forming a wedge-shaped engaging edge with a pointed edge for penetrating into the gap between the lamp holder and socket of the lamp assembly. The distal edge of the device, when closed in the rest position, preferably includes a concave recess adapted for snugly receiving a lamp holder. That is, the concave recess preferably has a cross section and edge only slightly larger than the cross-section and outer profile of the lamp holder at the area of junction with the lamp holder socket.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other filled bread products for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention, reference should be made to the following detailed description taken in with the accompanying drawings in which there are shown.

DETAILED DESCRIPTION OF THE INVENTION

Figure 1:
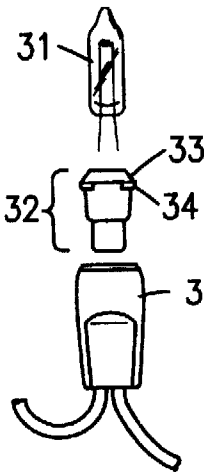
FIG. 1 An exploded view showing the components of a miniature lamp assembly.
Figure 2:
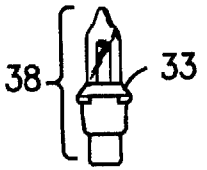
FIG. 2 A view of a miniature lamp secured in its holder
Figure 3:
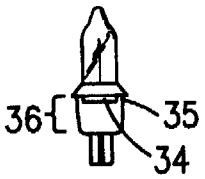
FIG. 3 The view of FIG. 2 rotated ninety degrees.
Figure 4:
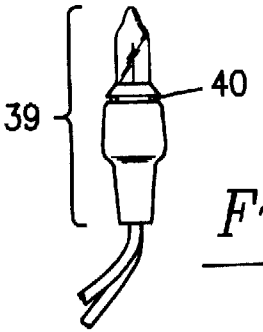
FIG. 4 A view of a complete miniature lamp holder assembled.

Illustrative embodiments of the invention will be described in detail with reference to the accompanying drawings. By referring to FIG. 1, it can be seen that a miniature lamp assembly consists of three components: the lamp (31), the lamp holder (32) which securely contains the lamp, and the socket (37) which snugly receives and releasably holds the lamp holder. The lamp (31) and its holder (32) are united to form an assembly (38) as shown in FIG. 2 and in FIG. 3. A lamp/holder assembly (38) is inserted into the socket (37) to create the final complete assembly (39) as depicted in FIG. 4.

The lamp holder (32) has a flange or collar portion (33) on the top surrounding the opening for receiving the lamp. Immediately beneath the collar portion (33) are raised radial spacer projections (34) on two opposite sides of the body of the lamp holder (32) which serve to form a gap (40) between the collar portion (33) and socket (37) along the two remaining sides of the lamp holder (32) after the lamp holder (32) is inserted into the socket (37) to form the assembly (39).

Depending upon the manufacturer and specific model of the lamp assembly, the collar (33) may vary in thickness and diameter, the raised spacer portion (34) of the lamp holder may vary in thickness, and the cross-sectional diameter of the lamp holder (32) may vary. The body (35) of the lamp holder (32) is a tapered cylinder of some length (36) with the tapered diameter decreasing in the direction of the socket (37). The socket (37) has a matching tapered cylindrical cavity to receive the tapered lamp holder body (35).

When the lamp holder (32) is firmly forced into the socket (37) the frictional forces between the tapered lamp holder body (35) of the lamp holder (32) and the tapered cavity of the socket (37) serve to securely retain the lamp holder (32) in the socket (37). The frictional forces are greatly multiplied by the taper between the lamp holder body (35) and the socket (37). The force required to extract the lamp holder ( ) from the socket (37) by overcoming the frictional forces between the tapered lamp holder body (35) and the socket (37) is significantly greater than the force required to insert the lamp holder (32) into the socket (37).

Figure 5:
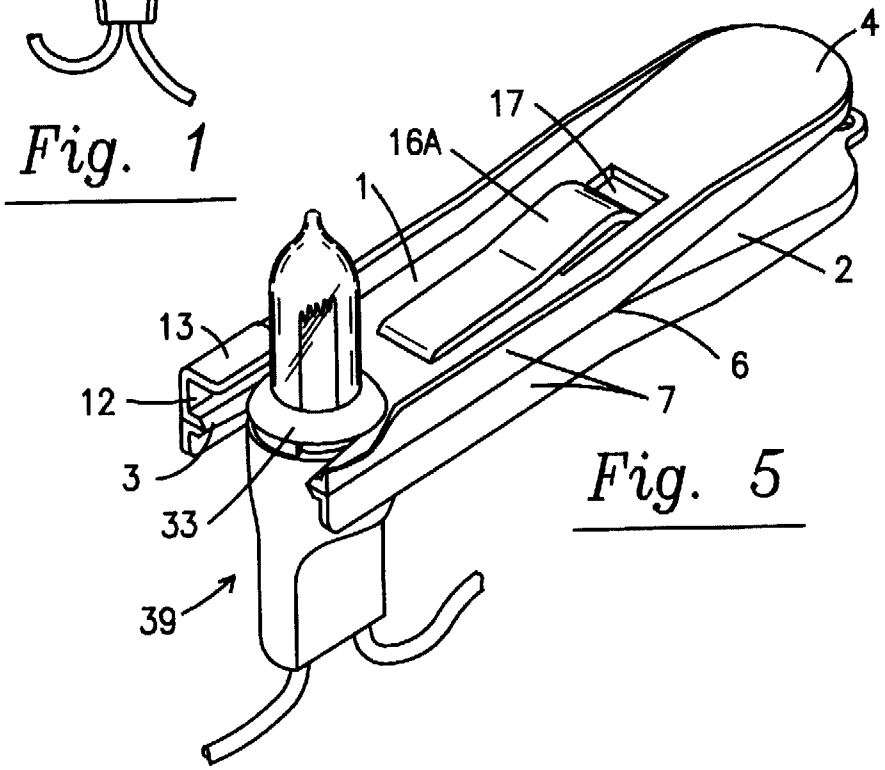
FIG. 5 An cutaway isometric view of the invention with a miniature lamp assembly inserted for action.
Figure 6:
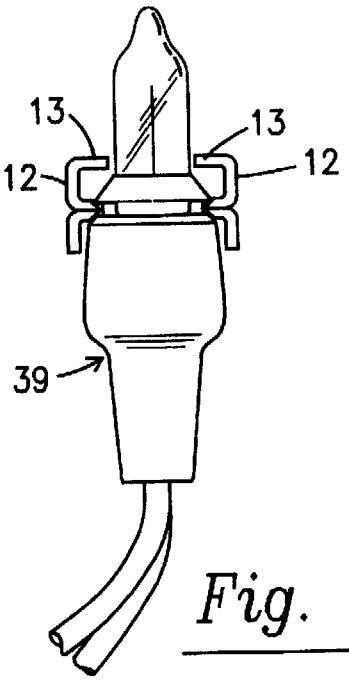
FIG. 6 An end view of FIG. 5.
Figure 8:
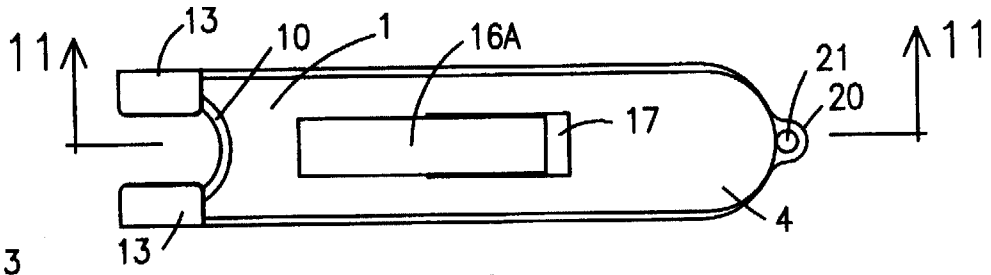
FIG. 8 A top view of the invention.

The device of the present invention as depicted in use in FIGS. 5 and 6 has generally planar distal end segment of upper elongate member (1) of a width greater than the maximum diameter of a lamp holder collar (33) which is to be engaged, and a flat lower elongate member (2), which may be a generally mirror-image part provided in mirror-image relation to elongate member (1), with a distal end of a width greater than the maximum diameter of a lamp holder socket (37). Each elongate member has a distal end (3) for engaging the cleft between the lamp holder (32) and the socket (37), and a proximal end for manipulation by hand (4).

Figure 9:
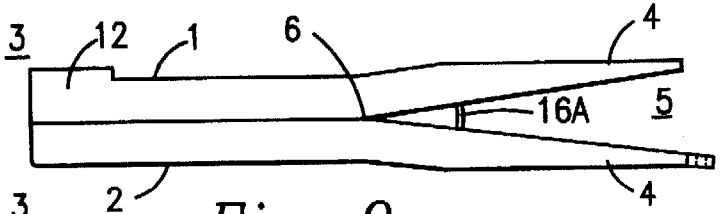
FIG. 9 A side view of FIG. 8.
Figure 12:
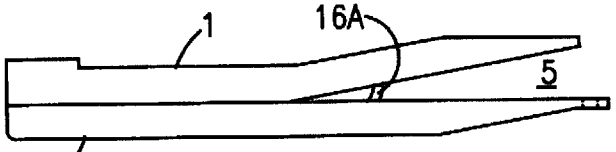
FIG. 12 A view of an alternate configuration for FIG. 9.

As show in FIG. 9 and FIG. 12, one or both elongate members may be bent at some point between the distal end (3) and the proximal end (4) at an acute angle to form an opening (5) between the proximal ends (4) of the upper elongate member (1) and the lower elongate member (2). Each elongate member thus bent serves as a class one lever with a fulcrum established by the bend point (6). The bend point (6) can be varied along the longitudinal axis of the elongate member(s) in order to achieve any desired mechanical advantage since the mechanical advantage achieved is in direct relation to the length of the elongate member on either side of a fulcrum. Further, the bend point and degree of bend determine the maximal spatial separation which will be produced between distal jaws in the open or distal position. This limitation of the distance to which the distal ends of the device will separate has the advantage of ensuring that the light holder extraction is always under positive control.

The upper elongate member (1) and lower elongate member (2) may be made of metal or plastic or any other material suitable to withstand the leverage forces required. Additional, either or both of the elongate members may have side walls (7) of some height and thickness to aid in strengthening and imparting bend resistance to the elongate member.

Figure 10B:
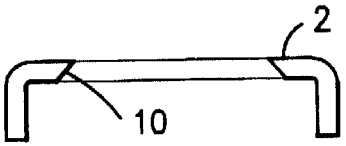
FIG. 10 An enlarged view of the tapered wedge opening in the distal end of the lower elongate member.
Figure 7:
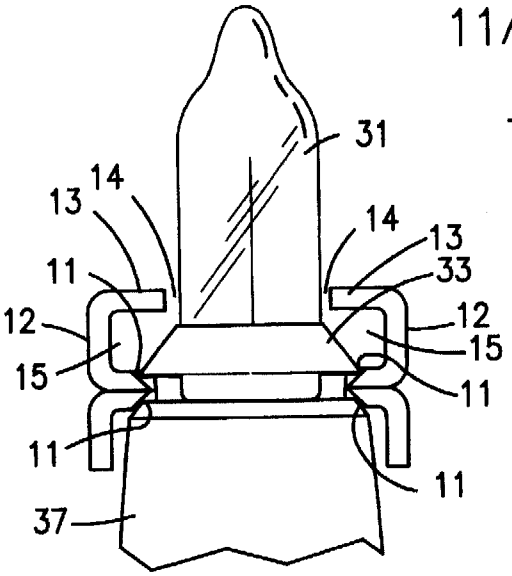
FIG. 7 An enlarged view of FIG. 6.
Figure 10A:
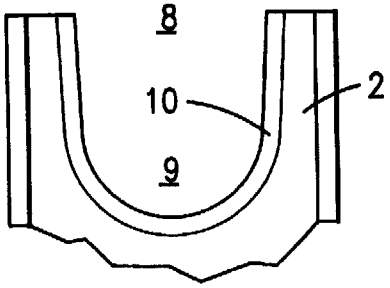

FIG. 10 illustrates the distal end (3) of each elongate member and depicts a tapered opening (8) slightly larger at the broader end than the anticipated maximum diameter of currently available lamp holder bodies and tapering to define a semicircle (9) slightly larger than the anticipated minimum diameter of currently available lamp holder bodies. This way, the tapered opening can receive various light holders with a range of diameters, conventionally anywhere from ¼ to ⅜ inch in diameter. The entire opening thus formed has a tapered wedge shaped engagement edge (10). When the distal end (3) of the upper elongate member (1) is held against the mating face of the distal end (3) of the lower elongate member (2) in the rest position, the complementary wedge shaped edges (10) of the upper elongate member (1) and the lower elongate member (2) combine to form a knife shaped edge (11) as depicted in the enlarged end view of FIG. 7.

In the embodiments shown in the figures, the upper elongate member (1) has vertical walls (12) upwardly directed on two opposite sides at an angle of approximately ninety degrees to the flat portion of the upper elongate member (1) and at least approximately the length of the tapered opening (8) and semicircular ending (9). This wall (12) may extend the entire length of the device as a reinforcing side wall (7), if it is decided that a side wall (7) is needed for added for strength. The height of the wall (12) is sufficient to accommodate the maximum anticipated thickness height of the lamp holder collar (33).

Each of the vertical walls (12) has a flange protrusion (13) projecting at an angle of approximately ninety degrees to the wall (12), approximately parallel with the upper distal elongate member (1) and projecting toward each other. The flanged protrusions (13) are limited in length to allow a gap (14) slightly larger than the maximum anticipated diameter of a miniature lamp (31). The vertical walls (12) and the flanged protrusions (13) serve to form an open enclosure (15) on two opposite sides of the upper elongate member (1) parallel with the tapered opening (8).

In actual use the complete assembly (39), or at least the socket (37), is generally secured in one hand while the device is held in the other. The distal ends (3) of the upper elongate member (1) and the lower elongate member (2) are held together with the tapered engaging edge (10) of the upper elongate member (1) and the matching tapered engaging edge (10) of the lower elongate member (2) in complementary alignment with each other. The knife shaped edge (11) of the opening (8) in the distal end (3) of the device is aligned with and inserted along the gap (40) between the lamp holder collar (33) and the socket (37). The device is inserted until the knife shaped edge (11) is firmly in contact with the lamp holder body (35) or until the lamp holder body (35) is in contact with the semicircular end (9) of the tapered opening (8). The top surface of the wedge shaped edge (10) of the upper elongate member (1) is thus engaged directly against the lower edge of the lamp holder collar (33) or the raised projection (34) thereof. The bottom surface of the wedge shaped edge (10) of the lower elongate member is thus engaged directly against the top surface of the lamp holder socket (37).

Force is applied to the top surface of the proximal end (4) of the upper elongate member (1) and/or to the bottom surface of the proximal end (4) of the lower elongate member (2). The applied force causes the proximal end (4) of the upper elongate member and the proximal end (4) of the lower elongate member (2) to move toward each other through the distance (5) between them by pivoting on the fulcrum point (6). Force is applied by the fingers of the hand or through any intermediate device such as a pair of common household pliers.

The applied force is transferred to the distal end (3) of each elongate member in direct proportion to the length of each end of each elongate member from the fulcrum point (6). The transferred force acts in a direction opposite to the direction of the applied force causing the distal ends (3) of the device to separate as the proximal ends (4) are forced toward each other.

The engagement of the wedge shaped edge (10) of the upper elongate member (1) against the bottom edge of the lamp holder collar (33) and the engagement of the wedge shaped edge (10) of the lower elongate member (2) against the top edge of the socket (37) transfer the applied force from the upper elongate member (1) to the lamp holder (32) and from the bottom elongate member (2) to the socket (37) thereby overcoming the frictional forces retaining the lamp holder (32) in the socket (37) and thus extracting the lamp holder (32) from the socket (37).

After the lamp holder (32) is freed from the socket (37) it is retained in the encapsulated area (15) bounded on one end by the semicircular end (9) of the tapered opening (8). The extracted lamp holder (32) is withdrawn or released from the device by tilting the distal end (3) of the device downward or by grasping the lamp (31) and lamp holder (32) and removing them with the fingers. No activation of the device is required.

Figure 11:
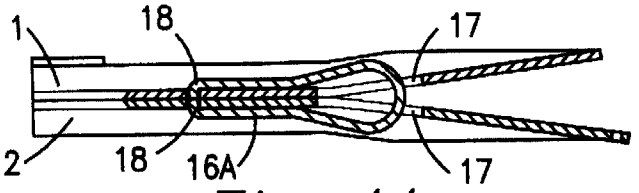
FIG. 11 A cross sectional view of the device taken through a point between points 22 and 23 in FIG. 8, and in the same projection as FIG. 9.
Figure 13:
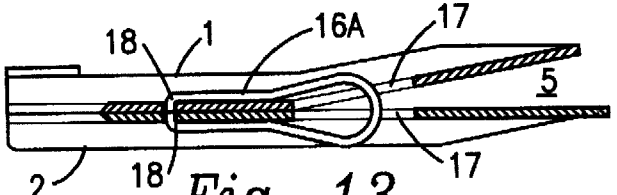
FIG. 13 A view of FIG. 11 using the alternate configuration of FIG. 12.
Figure 14:
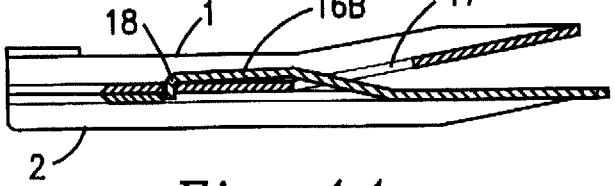
FIG. 14 A view of FIG. 12 showing an alternate configuration for a spring clamp.
Figure 15:
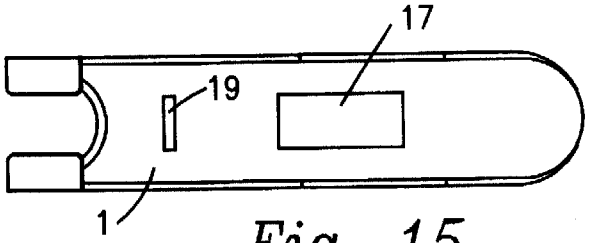
FIG. 15 A top view, looking down, of the upper elongate member depicted in the invention.
Figure 16:
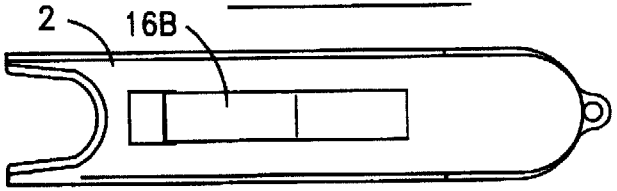
FIG. 16 A bottom view, looking up, of the alternate configuration in FIG. 14.
Figure 17:
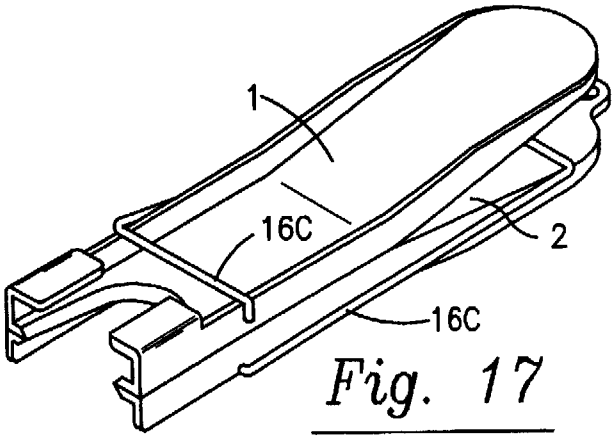
FIG. 17 An isometric view of the invention showing an alternate configuration for a spring clamp.

To assist the user in maintaining the upper elongate member (1) and the lower elongate member (2) in the correct alignment and positions relative to each other a simple spring clamp (16A) is included as part of the device. Although there are many ways to provide this feature, only three are depicted in the drawings. FIGS. 5, 8, 9, and 11 depict a simple flat hairpin shaped clamp (16A) which enters the upper elongate member (1) and the lower elongate member (2) through rectangular openings (17) and is retained in position by end tabs (18) which drop into rectangular openings (19). FIG. 11 is a cross sectional view of FIG. 8 taken along the line between (22) and (23) further depicting the configuration. FIG. 13 depicts this type of spring clamp in the alternate bend configuration mentioned earlier. FIG. 14 depicts a spring clamp (16B) where one half of the spring clamp (16*b*) is formed from one of the elongate members. In this method, only one opening (17) and one opening (19) are required in the cooperating elongate member. FIG. 17 depicts a simple clothes-pin type spring clamp (16C) which accomplishes the same end result.

In all instances, the various spring clamps depicted do not assist in accomplishing the objective of the device which is to remove the lamp holder from the socket.

A further convenience is provided in the form of a projection (20) extending out from the proximal end (4) of one of the elongate members with a hole (21) through which some type of lanyard, cord or key chain can be attached for securing the device against loss. The device is constructed to have an overall size of approximately ½ to ¾ inches in width, ¼ to M inch in height, 2–3 inches in length, and with a light holder receiving opening of from ⅜ to ⅝ inches, preferably ⅝ inch, at the mouth opening or the broadest point of the light holder receiving opening, so that the device has the overall dimensions of large finger nail clippers or keys, and is thus particularly suited to fitting on a key chain.

In a yet further illustrative embodiment, the device according to the present invention may be constructed by placing a slender rod, tube, or dowel transversely between two elongated members which are substantially identical to those discussed above, except that the need not have any bends and may in fact be straight or near straight. The rod, tube or dowel acts as both a spacer and fulcrum, about which the elongate members may pivot in the manner described above.

Although the device for separating and removing friction lamp holders from their sockets has been described herein with great detail with respect to embodiments for extracting Christmas lights, it will be readily apparent that the device is capable of use in a number of other applications. Although this invention has been described in its preferred form with a certain of particularity with respect to a device for separating and removing friction lamp holders from their sockets, it is understood that the present disclosure of the preferred form has been made only by way of example and that numerous changes in the details of structures and the composition of the combination may be resorted to without departing from the spirit and scope of the invention.

Now that the invention has been described,

I claim:

1. A device for extracting a lamp holder from a socket of a lamp assembly, said device comprising:

upper and lower elongate members, each elongate member having a proximal end for grasping by the hand and a distal end for engaging the lamp assembly, said upper and lower elongate members joined to pivot relative to each other between a rest position and an operating position, wherein said distal ends are in contact and said proximal ends are spaced apart when said device is in said rest position and said distal ends are spaced when said device is in the operating position;

wherein said distal ends of said upper and lower elongate members form a concave edge;

wherein the device is formed of a sheet of material having a thickness in the range of from 0.01 to 0.1 inches;

wherein at least one of elongate members is provided with longitudinal strengthening members;

wherein said elongate members are generally planar, and wherein said strengthening members are formed by bending the longitudinal edges of said elongate members away from said plane of said elongate member; and wherein said strengthening member is perpendicular to said plane of said elongate member.

2. A device for extracting a lamp holder from a socket of a lamp assembly, said device comprising:

upper and lower elongate members, each elongate member having a proximal end for grasping by the hand and a distal end for engaging the lamp assembly, said upper and lower elongate members joined to pivot relative to each other between a rest position and an operating position, wherein said distal ends are in contact and said proximal ends are spaced apart when said device is in said rest position and said distal ends are spaced when said device is in the operating position;

wherein said distal ends of said upper and lower elongate members form a concave edge;

wherein said device includes resilient means for biasing the device towards said rest position; and wherein said resilient means comprises a tongue formed from one of said upper and lower members, said tongue engaging said other of said upper and lower members.

* * * * *